US005927137A

United States Patent [19]

Sinteff

[11] Patent Number: 5,927,137

[45] Date of Patent: Jul. 27, 1999

[54] DEEP-DRAWING TOOL FOR FORMING AN ORIFICE WITH A TRUNCATED END IN A METALLIC STRIP MATERIAL

[75] Inventor: Roland Sinteff, Hilbesheim, France

[73] Assignee: Ferco International Ferrures et Serrures de Batiment, Sarrebourg, France

[21] Appl. No.: 09/079,764

[22] Filed: May 15, 1998

[30] Foreign Application Priority Data

May 20, 1997 [FR] France ..... 97 06280

[51] Int. Cl.[6] ..... B21D 28/34

[52] U.S. Cl. ..... 72/335; 72/470

[58] Field of Search ..... 72/327, 326, 335, 72/325, 470

[56] References Cited

U.S. PATENT DOCUMENTS 3,108,371 10/1963 Munse ..... 72/325
3,245,465 4/1966 Young ..... 72/327
3,878,950 4/1975 Quinn ..... 72/335

FOREIGN PATENT DOCUMENTS 554303 7/1932 Germany .
1268267 11/1986 Russian Federation ..... 72/335

*Primary Examiner*—Daniel C. Crane
*Attorney, Agent, or Firm*—Harrison & Egbert

[57] ABSTRACT

A tool for shaping, by deep drawing, a truncatedly ending round orifice in a metallic strip material, viz. for manufacturing a faceplate for a locking fitting or the like, includes both a punch and a die. The punch includes a cylindrical portion forming the extension of a truncated portion, whereas the die includes a bore with a cross-section adjusted to that of the cylindrical portion of the punch, this bore having, at the level of its wall, at least a groove ending at the upper face of this die, in front of the strip material to be shaped, into this or these grooves escaping the material during deep drawing of the truncated end.

4 Claims, 1 Drawing Sheet

DEEP-DRAWING TOOL FOR FORMING AN ORIFICE WITH A TRUNCATED END IN A METALLIC STRIP MATERIAL

BACKGROUND OF THE INVENTION (1) Field of the Invention

The invention relates to a tool for shaping, by deep drawing, a truncatedly ending orifice in a metallic strip material, viz. for manufacturing a faceplate for a locking fitting or the like for a door, window or the like, comprising at least a punch and a die. The invention also relates to a faceplate comprising at least a truncatedly ending orifice shaped by deep drawing by means of this tool.

As appears above, this invention in particular relates to the field of the building ironmongery.

(2) Description of the Prior Art

Many fittings, viz. locking fittings, include a faceplate for covering the organs of the locking mechanism, viz. an actuating rod that is accommodated e.g. in a groove provided for at the periphery of a leaf corresponding to a door, window or the like. Such faceplates are kept in place by means of fixing organs, such as screws, that pass through the faceplate to penetrate into the carpentry while passing, should the case arise, through an elongated opening provided for in an actuating rod.

In order not to create, at the level of the visible external face of the faceplate, an obstacle likely to hinder the actuation of the leaf or that would require to increase the backlash at the level of the fillister of this leaf with respect to the sash-frame, the screws usually used are of the sunken-head type, whereby they are accommodated in the truncated end of the orifice for the passing through of the screw present in the faceplate.

Therefore, when shaping this faceplate, several such troncatedly ended orifices have to be provided for alongside this latter, which presently arises a problem, since it is known that this is to be carried out under high-rhythm manufacturing circumstances. Thus, the solution of a machining in the form of a boring followed by a milling is not suited at all for such production rhythms. As a matter of fact, such faceplates are usually shaped by deep drawing, which solution is much better suited for this case. The deep drawing of a strip material having a small width and a small thickness is however a delicate operation to be performed and often results in problems of distortion, in particular when the machining to be carried out does not consist of a mere operation of removal of material through cutting out.

By way of an example, though no difficulty arises for the provision of an orifice in a faceplate, because this indeed results in a mere removal of material, the provision of a truncated end at the level of this orifice results into a creep of material, thus often into a change of the outer sizes of the faceplate. Thus, if this creep of material is not restrained, the faceplate gets a slightly increased width at the level of a truncatedly ended orifice resulting from a deep-drawing process. Finally, this may result in difficulties when mounting this faceplate.

There has already been conceived a process capable of ensuring the control of the creep of material resulting, in particular, from the machining, through deep drawing, of the truncated end corresponding to an orifice previously provided for in a strip material having a small width and a small thickness.

As a matter of fact, this process consists of making in this strip material first of all an orifice the cross-section of which is slightly larger than that it must finally have. Then, during a second operation, the truncated end is made by means of a correspondingly shaped punch, which results into a creep of material in the lower portion of the orifice towards the axis of this latter the cross-section of which therefore becomes smaller. This creep of material is kept under control by means of a die including, on its upper face, a circular crown having a triangular cross-section the apex of which is oriented towards the lower face of the strip material to be shaped and which defines, during the deep-drawing operation, a circular groove concentrical to the orifice on this lower face of the strip material.

As results from the preceding description, this process has the drawback that one has to proceed in two steps, which, of course, results in a loss of time applied to faceplates for fittings, such as locking fittings or the like, and this results into a limited production rhythm.

In addition, it should be observed that the final cross-section of the orifice depends on the thickness of the strip material, this assuming the travel of the truncatedly shaped punch corresponds to an invariable value. Therefore, one understands that it is impossible to accurately adjust this cross-section of the orifice serving as a passageway for the fixing screw.

SUMMARY OF THE INVENTION

This invention is meant to solve all the above-mentioned problems through a tool enabling one to perfectly keep under control the creep of metal, during the deep drawing in one single operation, of a truncatedly ended orifice in a strip material, such as a faceplate.

For this purpose, the invention relates to a tool for shaping by deep drawing a truncatedly ending orifice in a metallic strip material, viz. for manufacturing a faceplate for a locking fitting or the like for a door, window or the like, comprising at least a punch and die, characterized in that:

- the punch includes a cylindrical portion with a diameter adapted to the diameter of the orifice to be made in the strip material, this cylindrical portion forming the extension of a truncated portion with a shape suitable for the machining through deep drawing of the truncatedly shaped end,
- the die includes a bore with a cross-section adjusted to that of the cylindrical portion of the punch, this bore having, at the level of its wall, at least a groove ending at the upper face of this die in front of the strip material, this or these grooves and the axis of the bore being located in an alignment substantially parallel to the longitudinal axis of the strip material during the shaping of this latter.

The invention in addition relates to a faceplate, viz. for a locking fitting or the like, shaped by deep drawing by means of the tool according to the invention. This faceplate including at least a truncatedly ending orifice is characterized in that it includes, on its rear face and at the rim of the orifice, a boss which is located with the axis of the orifice in an alignment parallel to the longitudinal axis of the faceplate.

Finally, it should be observed that the inventive step corresponding to this invention results from the fact that the creep of metal is so kept under control that it defines, on the rear face of the faceplate, a boss that does in no way hinder the movement of an eventual actuating rod covered by this faceplate. In front of the truncatedly shaped orifice serving as a passageway for the fixing organ, the rod indeed necessarily includes an elongated opening allowing the passing through of the fixing screw, while allowing this rod to freely move. Accordingly, this boss coincides with this elongated opening in the rod and can, to some extent, improve the axial guiding of this latter.

The invention will be better understood when reading the following description related to an embodiment shown in the attached drawing.

DESCRIPTION OF THE PREFERRED EMBODIMENTS

Figure 1:
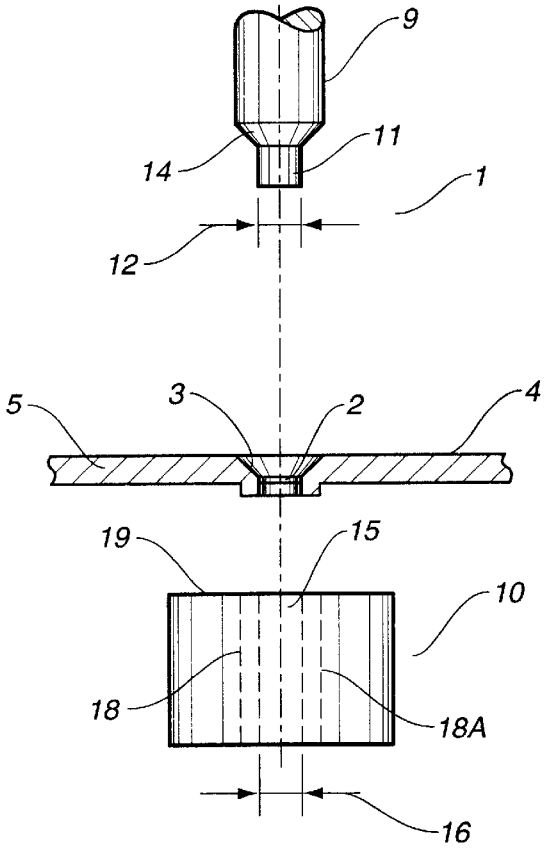
FIG. 1 shows a schematical and elevational view of the tool according to the invention comprising a punch and a die between which is schematically shown in broken lines a strip material, viz. a faceplate, comprising a truncatedly ending orifice achieved by deep drawing by means of this tool.

As appears from the figures of the attached drawings, this invention relates to a tool 1 for shaping, by deep drawing, an orifice 2 with a truncated end 3 in a metallic strip material 4 for manufacturing, in particular, a faceplate 5 for a locking fitting or the like for a door, window or the like.

In this respect, such a faceplate 5 is very often accommodated in a cut-out or in a groove provided for in the fillister of a leaf, in some cases even in a sash-frame, of such a door or window. The keeping in place of this faceplate 5 is usually insured by fixing organs, such as sunken-head screws, that, as a matter of fact, pass through an orifice 2 provided for in the faceplate 5 to penetrate into the carpentry, regardless of this latter being of wood, plastic or metal. In order to avoid these fixing organs from protruding with respect to the front face 6 of the faceplate 5, the orifices 2 provided for in this faceplate include a truncatedly shaped end 3 for receiving the sunken heads of the screws.

It should in addition be noticed that such a faceplate usually has to cover an actuating rod 7 capable of moving in the groove or in the cut-out present in this carpentry and closed by the faceplate 5. Therefore, this actuating rod 7 includes, in front of the fixing organs of this latter, elongated openings 8 that, as a matter of fact, enable the passing through of these fixing organs, while allowing said actuating rod 7 to freely move.

As regards the tool 1 in particular for shaping, by deep drawing, such an orifice 2 with a truncated end 3, it comprises at least a punch 9 and a die 10.

As a matter of fact, according to the invention, the punch 9 includes a cylindrical portion 11 with a diameter 12 adjusted to the diameter 13 of the orifice 2 to be provided for in the strip material 4, in particular in the faceplate 5. This cylindrical portion 11 forms the extension of a truncated portion 14 the shape of which is adapted to the machining, by deep drawing, of the truncated end 3.

As regards the die 10, it includes a bore 15 with a cross-section 16 adjusted to that of the cylindrical portion 11 of the punch 9, this bore 15 having, at the level of its wall 17, at least one groove 18 ending at least at the upper face 19 of the die 10, in front of said strip material 4 to be shaped. It should be noted, in particular, that the axis 20 of the bore 15 and the groove or grooves 18 are located in an alignment 21 substantially parallel to the longitudinal axis 22 of the strip material 4.

Figure 2:
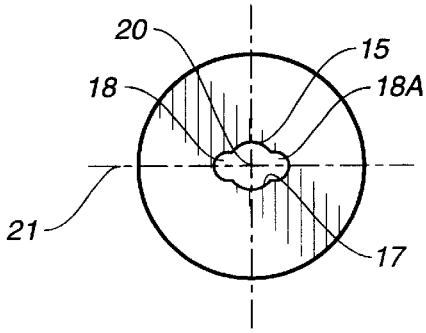
FIG. 2 shows a schematical top view of the die.
Figure 3:
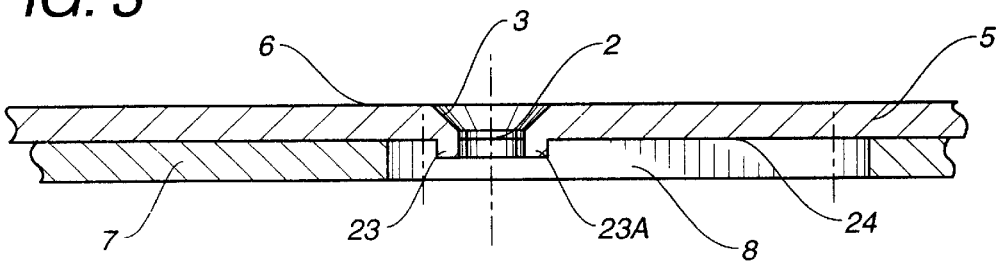
FIG. 3 is a schematical cross-sectional view of a faceplate according to the invention covering an actuating rod.
Figure 4:
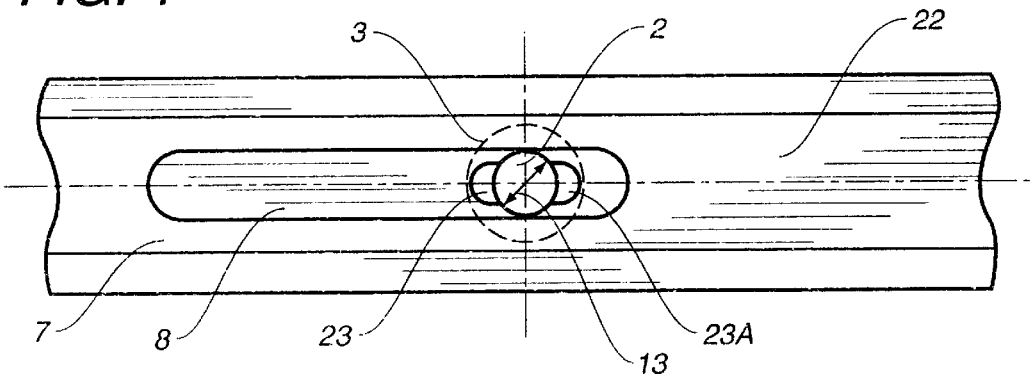
FIG. 4 is a schematical view from beneath of FIG. 3.

As shown in FIG. 2, the die 10 includes at least two grooves 18, 18A provided for diametrically opposed at the level of the wall 17 of the bore 15.

In addition, since in particular a faceplate 5 has to be shaped, the axis 20 of the bore 15 and the grooves 18, 18A of the die 10 are located in an alignment substantially corresponding to the longitudinal median plane of this faceplate 5 when this latter is located at the level of the tool 1.

Finally, thanks to this latter, the operation of shaping, by deep drawing, of an orifice 2 with a truncated end 3 may be carried out in one single deep-drawing operation, since the punch 9 allows to simultaneously define the orifice 2 to its final dimensions and the truncated end 3. In this respect, the creep of metal resulting from the punching of this truncated end 3 is perfectly under control and restricted by means of the die 10. Because of the grooves 18, 18A present in this die 10, this creep of material indeed defines bosses 23, 23A at the level of the rear face 24 of the strip material 4, in particular of the faceplate 5.

Furthermore, because of the judicious arrangement of these grooves 18, 18A at the level of the die 10, this with respect to the strip material 4, the bosses 23, 23A defined on the rear face 24 of the faceplate 5 are located at the rim of the orifice 2, in particular on both sides of this latter, on the longitudinal axis 22 of this faceplate 5. Accordingly, these bosses 23, 23A necessarily coincide with an elongated opening 8 in an actuating rod 7 eventually covered by this faceplate 5 and do in no way hinder the movement of this actuating rod 7. To the contrary, these bosses 23, 23A contribute to a better axial guiding of this actuating rod 7 with respect to the faceplate 5.

I claim:

1. A tool for shaping by deep drawing an orifice with a truncated end in a metallic strip material, the metallic strip material having a longitudinal axis, the tool being used to manufacture a faceplate for a locking fitting for a door or window, the tool comprising:

a punch having a cylindrical portion and a truncated portion, said punch having a longitudinal axis, said cylindrical portion having a circular cross section in a plane transverse to said longitudinal axis of said punch, said cylindrical portion extending from a narrow end of said truncated portion, said truncated portion having a circular cross section in a plane transverse to said longitudinal axis of said punch;

a die having a bore with a longitudinal axis aligned with said longitudinal axis of said punch, said bore adapted to matingly receive said cylindrical portion of said punch, said die having a groove extending along and into a wall of said bore, said groove having a radius extending transverse to said longitudinal axis of said punch, said bore and said groove being arranged in a plane transverse to said longitudinal axis so as to have an axis parallel to the longitudinal axis of the metallic strip material during the shaping of the metallic strip material, said die having an upper face adapted to receive the metallic strip material thereon.

2. The tool according to claim 1, wherein said die has two grooves extending along and into said wall of said bore, said two grooves being diametrically opposed to each other.

3. An apparatus for forming an orifice with a truncated end in a faceplate for a locking fitting for a door or window, the apparatus comprising:

a metallic strip material having longitudinal median plane;

a punch having a cylindrical portion and a truncated portion, said punch having a longitudinal axis, said cylindrical portion and said truncated portion having a circular cross section in a plane transverse to said longitudinal axis, said cylindrical portion extending from a narrow end of said truncated portion; and a die having a bore with a longitudinal axis aligned with said longitudinal axis of said punch, said cylindrical portion of said punch being matingly receivable within said bore of said die, said die having an upper face receiving said metallic strip material thereon, said upper face and said metallic strip material extending in a plane transverse to said longitudinal axis of said bore, said die having a groove extending along and into a wall of said bore, said groove having a radius extending transverse to said longitudinal axis of said bore, said bore having a diameter, said diameter of said bore and a radius of said groove being located in said longitudinal median plane of said metallic strip material.

4. The apparatus of claim 3, wherein said die has two grooves extending along and into said wall of said bore, said two grooves being diametrically opposed to each other.

* * * * *